US005300393A

United States Patent [19]

Odell et al.

[11] Patent Number: 5,300,393

[45] Date of Patent: Apr. 5, 1994

[54] IMAGING MEMBERS AND PROCESSES FOR THE PREPARATION THEREOF

[75] Inventors: Peter G. Odell, Mississauga; Trevor I. Martin, Burlington; James D. Mayo, Toronto, all of Canada

[73] Assignee: Xerox Corporation, Stamford, Conn.

[21] Appl. No.: 929,227

[22] Filed: Aug. 14, 1992

[51] Int. Cl.[5] ..... G03G 5/00

[52] U.S. Cl. ..... 430/134; 430/130; 430/59; 528/370

[58] Field of Search ..... 430/127, 130, 132, 134, 430/59, 70, 96; 528/370, 371

[56] References Cited

U.S. PATENT DOCUMENTS

| | | | |
|---|---|---|---|
| 4,265,990 | 5/1981 | Stolka et al. | 430/59 |
| 4,415,639 | 11/1983 | Horgan | 430/59 |
| 4,551,404 | 11/1985 | Hiro et al. | 430/59 |
| 4,555,463 | 11/1985 | Hor et al. | 430/59 |
| 4,587,189 | 5/1986 | Hor et al. | 430/59 |
| 4,605,731 | 8/1986 | Evans et al. | 528/371 |
| 4,644,053 | 2/1987 | Brunnelle et al. | 528/371 |
| 4,888,441 | 12/1989 | Calbo, Jr. et al. | 560/198 |
| 5,166,021 | 11/1992 | Odell et al. | 436/59 |
| 5,232,804 | 8/1993 | Molaire | 430/134 |

*Primary Examiner*—Steve Rosasco
*Attorney, Agent, or Firm*—E. O. Palazzo

[57] ABSTRACT

A process for the preparation of photoconductive imaging members which comprises coating a supporting substrate with a photogenerator layer comprised of photogenerating pigments and a mixture of cyclic oligomers wherein said mixture is heated to obtain a polycarbonate resin binder, and subsequently applying to the photogenerating layer a layer of charge transport molecules.

21 Claims, No Drawings

IMAGING MEMBERS AND PROCESSES FOR THE PREPARATION THEREOF

BACKGROUND OF THE INVENTION

This invention is generally directed to imaging members and processes for the preparation thereof. More specifically, the present invention relates to layered photoconductive imaging members with excellent mechanical characteristics, and which members contain high molecular weight and narrow dispersity polymers. In embodiments, the present invention is directed to the fabrication of photogenerating layers by the in situ polymerization of mixtures of macrocyclic oligomers and photogenerating pigments. The aforementioned photoresponsive imaging members can be negatively charged when the photogenerating layer is situated between the charge transport layer and the substrate, or positively charged when the charge transport layer is situated between the photogenerating layer and the supporting substrate. The layered photoconductive imaging members can be selected for a number of different known imaging and printing processes including, for example, electrophotographic imaging processes, especially xerographic imaging and printing processes wherein negatively charged or positively charged images are rendered visible with toner compositions of the appropriate charge. Generally, the imaging members are sensitive in the wavelength regions of from about 400 to about 850 nanometers, thus diode lasers can be selected as the light sources in some instances.

Imaging members are usually prepared by first providing on a supporting substrate a photogenerating layer of, for example, trigonal selenium in a polymer binder. Photogenerating pigments are usually milled in an organic solvent to obtain a small particle size and certain morphology. The polymer binder is chosen with consideration of the aforementioned milling; phthalocyanine pigments, for example, are often converted to less sensitive morphologies by chlorinated solvents, and thus, the use of polymers that are only soluble in these solvents such as polycarbonate is normally precluded. Yet, polycarbonate because of its clarity and toughness is otherwise an acceptable polymer binder. This invention provides in embodiments the use of polycarbonate as a binder for photogenerating pigments since, for example, the cruical milling step takes place in the presence of a mixture of macrocylic carbonate oligomers rather than a high molecular weight polymer. The oligomer mixture is soluble in a wide variety of organic materials, and addition, needs not be dissolved at all since it is friable and can be broken down into small particles and widely dispersed among the pigment particles by milling. Conversion to high molecular weight polymer takes place after the solvent has been removed. Alternatively, coating may take place in the absence of solvent using powder coating methods. This invention in embodiments allows one to effectively prepare charge generation layers comprised of a polycarbonate binder and charge generating pigments. With the invention of the present application, in embodiments there is selected a mixture of macrocyclic carbonate oligomers and this mixture is converted into a polymer after or simultaneously with the coating of the charge generation layer. The advantages of the aforementioned include the provision of polycarbonate as a binder for pigments that are sensitive to chlorinated solvents. The processes of the present invention and imaging members thereof allows the charge generation binder to be optionally crosslinked to provide tougher coatings. Also provided are higher 100,000 to 300,000 polycarbonate films or polymers versus about 40,000 for spray coated molecular weight films formed using spray or dip coating techniques achieved with a polymer solution. The use of a solvent for forming a photoreceptor film may be avoided entirely with the present invention in embodiments by coating the cyclic oligomers and charge generation pigment mixture as a melt or a powder before curing the cyclic oligomers to obtain high molecular weight polymers. Additionally, by using mixtures of different structured cyclic oligomers high molecular weight copolymers of exact stoichiometry can be obtained that are not readily obtained by either the known interfacial or melt transesterification processes for producing polycarbonates.

Layered imaging members with photogenerating and charge transport layers, including charge transport layers comprised of aryl diamines dispersed in polycarbonates, like MAKROLON® are known, reference for example U.S. Pat. No. 4,265,900, the disclosure of which is totally incorporated herein by reference. More specifically in U.S. Pat. No. 4,265,900 there is illustrated an imaging member comprised of a photogenerating layer, and an aryl amine hole transport layer comprised of amine molecules dispersed in a polycarbonate. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Photoresponsive imaging members with squaraine photogenerating pigments are also known, reference U.S. Pat. No. 4,415,639. In this patent there is illustrated a photoresponsive imaging member with a substrate, a hole blocking layer, an optional adhesive interface layer, an organic photogenerating layer, a photoconductive composition capable of enhancing or reducing the intrinsic properties of the photogenerating layer, and a hole transport layer dispersed in resin binders like polycarbonates. As photoconductive compositions for the aforementioned members, there can be selected various squaraine pigments, including hydroxy squaraine compositions. Moreover, there are disclosed in U.S. Pat. No. 3,824,099 certain photosensitive hydroxy squaraine compositions.

The use of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Further, there is disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a perylene (BZP) pigment photogenerating component. Both of the aforementioned patents disclose an aryl amine component as a hole transport layer, and resin binders like polycarbonates.

Moreover, there are disclosed in U.S. Pat. No. 4,419,427 electrographic recording mediums with a photosemiconductive double layer comprised of a first layer containing charge carrier perylene diimide dyes, and a second layer with one or more compounds which are charge transporting materials when exposed to light, reference the disclosure in column 2, beginning at line 20.

In copending application U.S. Ser. No. 537,714 (D/90087), the disclosure of which is totally incorporated herein by reference, there are illustrated photoresponsive imaging members with photogenerating titanyl phthalocyanine layers prepared by vacuum deposition. It is indicated in this copending application that the imaging members comprised of the vacuum deposited titanyl phthalocyanines and aryl amine hole transporting compounds dispersed in resin binders like polycarbonates exhibit superior xerographic performance as low dark decay characteristics result and higher photosensitivity is generated, particularly in comparison to several prior art imaging members prepared by solution coating or spray coating, reference for example U.S. Pat. No. 4,429,029.

In copending patent application U.S. Ser. No. 905,697 (D/92090) filed Jun. 29, 1992, there is illustrated, for example, a process for the preparation of photoconductive imaging members which comprises coating a supporting substrate with a photogenerator layer comprised of photogenerating pigments, and subsequently applying to the photogenerating layer a mixture comprised of charge transport molecules and cyclic oligomers, and wherein said mixture is heated to obtain a polycarbonate resin binder from said cyclic oligomers.

The disclosures of all of the aformentioned publications, laid open applications, copending applications and patents are totally incorporated herein by reference.

SUMMARY OF THE INVENTION

It is an object of the present invention to provide imaging members and processes thereof with many of the advantages illustrated herein.

It is another object of the present invention to provide processes for photoconductive imaging members wherein the resin binder is obtained from heating a cyclic oligomer together with photogenerating pigments.

It is another object of the present invention to provide a method for obtaining a thin layer matrix of photogenerating pigments dispersed in a polycarbonate binder without the use of a chlorinated solvent.

It is yet another object of the present invention to provide processes, including effective spray, powder and dip coating processes for the preparation of imaging member layers.

Another object of the present invention is to provide high molecular weight polycarbonates from cyclic oligomers, and wherein the polycarbonates have a molecular weight of 100,000 Daltons, or greater, and more specifically, in the range of 100,000 to 500,000, and preferably in the range of 100,000 to 300,000, and with narrow distributions of two, for example, and in the range of 1.8 to 3.0.

Further, another object of the present invention resides in a process for the coating of low viscosity melts of macrocyclic carbonate oligomers and charge transport compounds onto a supporting substrate, or onto a photogenerating layer by, for example, known web methods.

In another object of the present invention there is provided the preparation of photogenerating layers by the in situ polymerization of mixtures of photogenerating pigments, and macrocyclic oligomers.

In yet another object of the present invention there is provided the preparation of photogenerating layers with minimal use or without the use of volatile organic solvents.

In embodiments, the present invention is directed to the preparation of charge generation compositions which comprises the polymerization of macrocyclic oligomers in the presence of charge generation pigments. More specifically, the process comprises the preparation of imaging members comprising the simultaneous formation of a photogenerating layer comprised of photogenerating pigments and a polycarbonate resin binder, and wherein the resin binder is formed from a cyclic oligomer mixture. In embodiments, the polycarbonate resin binder obtained from the cyclic oligomer is generated in the absence of a solvent.

The synthesis of BP(A) cyclic oligomers is based on the teachings of Brunelle et al., *Jour. Amer. Chem. Soc.*, 1990, 112, 2399–2402, the disclosure of which is totally incorporated herein by reference. The reaction can be conducted in a one liter Morton flask equipped with a mechanical stirrer, a condenser, septum, addition funnel and heating mantle. To this flask were added, for example, 200 milliliters of methylene chloride, 7 milliliters of deionized water, 3 milliliters of 9.75 Molar NaOH solution, and 2.4 milliliters of triethyl amine. Stirring and gentle reflux were then initiated. Bisphenol A bischloroformate, from VanDeMark Chemical Company of Lockport, NY, previously recrystallized from hexane, about 70.5 grams, was dissolved into 200 milliliters of methylene chloride and added to the flask by means of a peristaltic pump over the course of 40 minutes. Concurrently, about 59 milliliters of about 9.75 Molar sodium hydroxide solution was added by means of the addition funnel and about 2.4 milliliters of triethyl amine were added by means of a syringe pump. After 40 minutes, the reaction was terminated by the addition of 200 milliliters of 1M HCl solution. The reaction mixture was transferred to a separatory funnel where the organic and aqueous layers separated and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring sizes of cyclic oligomers of 4,4'-isopropylidenebisphenol carbonate. As Brunelle teaches in *Macromolecules*, 1991, 24, 3035, a mixture of different ring sizes, as opposed to a single discrete size, is important to achieve a lower melting and hence more readily processable material, and this is an article which extensively characterized the oligomers mixture that can be selected for the invention of the present application. Confirmation of the product structure was determined by GPC and NMR.

Moreover, in embodiments the present invention relates to processes for the preparation of photogenerating compositions by the in situ polymerization of mixtures of photogenerating pigments and macrocyclic oligomers. More specifically, these processes comprise placing 0.25 gram of a mixture of cyclic oligomers of 4,4'-isopropylidenebisphenol carbonate, 0.25 gram of x metal free phthalocyanine, 14.2 grams of cyclohexanone, and about 0.0005 gram of titanium butoxide in a 30 milliliter bottle containing 70 grams of ⅛ inch stainless steel shot and milled at 300 rpm for 5 days. The dispersion was then coated on aluminum film, heated to about 300° C. for 30 minutes to polymerize the cyclic oligomers, and then cooled. Subsequently, an approximately 20 micron thick charge transport layer of 35 weight percent of diphenyl-N-N'-bis(alkylphenyl)-[1,1'-biphenyl]-4,4'-diamine in MAKROLON® was overcoated on the above prepared photogenerating layer. Xerographic evaluation of the resulting photoconductive member was accomplished and a sensitivity of about 40 ergs/cm$^2$ was found.

Examples of photogenerating pigments include metal free phthalocyanines, such as x-form phthalocyanine, metal phthalocyanines, vanadyl phthalocyanines, titanyl phthalocyanines, especially Type IV titanyl phthalocyanine, squaraines, bisazos, trigonal selenium, amorphous selenium, selenium alloys, such as selenium tellurium, selenium tellurium arsenic, and other known photogenerating pigments. These pigments are present in various effective amounts, such as for example from about 5 to about 85 weight percent, in the formed polycarbonate resin binder. The thickness of this layer can vary, for example, from about 0.1 to about 10 microns in embodiments.

The photoresponsive imaging members of the present invention can be prepared by a number of known methods, the process parameters and the order of coating of the layers being dependent on the member desired. The imaging members suitable for positive charging can be prepared by reversing the order of deposition of photogenerator and charge transport layers. The photogenerating and charge transport layer of the imaging members can be coated as solutions or dispersions onto selective substrates by the use of a spray coater, dip coater, extrusion coater, roller coater, wire-bar coater, slot coater, doctor blade coater, gravure coater, and the like, and dried at from 40° to about 200° C. for from 10 minutes to about 10 hours under stationary conditions or in an air flow. The coating is accomplished to provide a final coating thickness of from 0.01 to about 30 microns for the aforementioned photogeneration layer.

Imaging members of the present invention are useful in various electrostatographic imaging and printing systems, particularly those conventionally known as xerographic processes. Specifically, the imaging members of the present invention are useful in xerographic imaging and printing processes wherein photogenerating pigments may absorb light of a wavelength of from about 400 nanometers to about 900 nanometers. In these known processes, electrostatic latent images are initially formed on the imaging member followed by development, and thereafter transferring the image to a suitable substrate.

Moreover, the imaging members of the present invention can be selected for electronic printing processes with gallium arsenide light emitting diode (LED) arrays which typically function at wavelengths of from 660 to about 830 nanometers.

DESCRIPTION OF SPECIFIC EMBODIMENTS

The negatively charged photoresponsive imaging member of the present invention can be comprised of a supporting substrate thereover, a photogenerator layer comprised of a photogenerating pigment dispersed in an resinous polycarbonate binder obtained with the process of the present invention, and a top hole transport layer comprised of N,N'-diphenyl-N,N'-bis(3-methyl phenyl)-1,1'-biphenyl-4,4'-diamine dispersed in a polycarbonate resinous binder, which transport layer can also be obtained with the processes of the present invention.

A positively charged photoresponsive imaging member of the present invention can be comprised of a substrate, a charge transport layer comprised of N,N'-diphenyl-N,N'-bis(3-methyl phenyl)-1,1'-biphenyl-4,4'-diamine dispersed in a polycarbonate resinous binder, and a photogenerator layer with an inactive resinous polycarbonate binder obtained with the process of the present invention.

Substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer such as indium tin oxide, or aluminum arranged thereon, or a conductive material inclusive of aluminum, chromium, nickel, brass and the like. The substrate may be flexible, seamless, or rigid and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness. In embodiments, the thickness of this layer is from about 75 microns to about 300 microns.

With further regard to the imaging members, the photogenerator layer is preferably comprised of x-metal type phthalocyanines or titanyl phthalocyanine pigments dispersed in resinous binders obtained with the processes of the present invention. Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the photogenerator pigment is present in an amount of from about 5 percent to about 80 percent by volume. In embodiments, this layer is of a thickness of from about 0.25 micron to about 1 micron when the photogenerator composition is present in this layer in an amount of 30 to 75 percent by volume. The maximum thickness of this layer in embodiments is dependent primarily upon factors, such as photosensitivity, electrical properties and mechanical considerations. The charge generator layer can be obtained by dispersion coating the photogeneration cyclic oligomer mixture obtained with the processes of the present invention. The dispersion can be prepared by mixing and/or milling the pigment in equipment such as paint shakers, ball mills, sand mills and attritors. The cyclic oligomers may be included in the milling step or added thereafter. Common grinding media such as glass beads, steel balls or ceramic beads may be used in this equipment. In embodiments of the present invention, it may desirable to select solvents that do not effect the other coated layers of the device. Examples of solvents useful for coating photogenerating dispersions to form a photogenerator layer include ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate and methoxyethyl acetate, and the like.

The coating of the photogenerating pigment dispersion in embodiments of the present invention can be accomplished with spray, dip powder or wire-bar methods such that the final dry thickness of the charge generator layer is from 0.01 to about 30 microns and preferably from 0.1 to about 15 microns after being dried at 40° to 150° C. for 5 to 90 minutes.

Aryl amines selected for the charge, especially hole transporting layer which generally is of a thickness of from about 5 microns to about 75 microns, and preferably of a thickness of from about 10 microns to about 40 microns, include components as illustrated in U.S. Pat. No. 4,265,900 and of the following formula

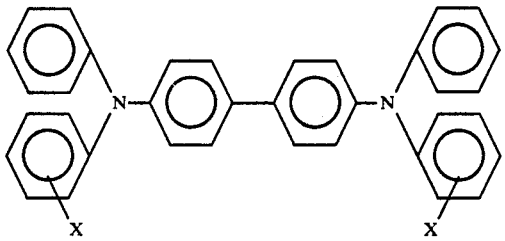

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-1,1-biphenyl-4,4'-diamine wherein alkyl is selected from the group consisting of methyl, such as 2-methyl, 3-methyl and 4-methyl, ethyl, propyl, butyl, hexyl, and the like. With chloro substitution, the amine is N,N'-diphenyl-N,N'-bis(halo phenyl)-1,1'-biphenyl-4,4'-diamine wherein halo is 2-chloro, 3-chloro or 4-chloro. Other known charge transport layer molecules can be selected, reference for example U.S. Pat. Nos. 4,921,773 and 4,464,450, the disclosures of which are totally incorporated herein by reference.

Examples of the highly insulating and transparent resinous material or inactive binder resinous material for the transport layers include the materials as illustrated herein, such as polycarbonates commercially available, or materials such as those described in U.S. Pat. No. 3,121,006, the disclosure of which is totally incorporated herein by reference. Specific examples of organic resinous materials in embodiments may include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active charge transport material, and preferably from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

In embodiments, the present invention is directed to a process for the preparation of photoconductive imaging members which comprises coating a supporting substrate with a photogenerator layer comprised of a mixture of photogenerating pigments and cyclic oligomers wherein said mixture is heated to obtain a polycarbonate resin binder, and subsequently applying to the photogenerating layer a layer of charge transport molecules; and a process for the preparation of a photoconductive imaging members which comprises coating a supporting substrate with a photogenerator layer comprised of photogenerating pigments and a mixture of cyclic oligomers with degrees of polymerization of from about 2 to about 20 and a catalyst, and wherein said mixture is heated to obtain a polycarbonate resin binder from said cyclic oligomers, and subsequently applying to the photogenerating layer a layer of charge transport molecules; and wherein in embodiments said cyclic oligomer mixture is comprised of components represented by the formula

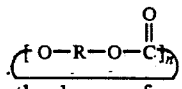

where n represents the degree of polymerization and is from 2 to about 20, and R represents the principle repetition unit of the formula

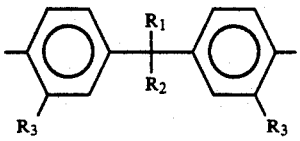

wherein $R_1$, $R_2$, and $R_3$ are independently selected from the group consisting of hydrogen, alkyl, 1 to about 20 carbons, aryl, 6 to about 24 carbons, halogen, halogen substituted alkyl and halogen substituted aryl. Examples of substituents include methyl, ethyl, propyl, butyl, phenyl, benzyl, naphthyl, chloro, and the like. Examples of catalysts include known components like aluminum di(isopropoxide)acetoacetic ester chelate, tetrabutylammonium tetraphenylborate, tetramethylammonium tetraphenylborate, titanium diisopropoxide bis(2,4-pentanedione), titanium tetraisopropoxide, titanium tetrabutoxide, tetraphenylphosphonium tetraphenylborate, lithium phenoxide, and lithium salicylate present in various effective amounts, such as for example from about 0.01 to about 1.0 weight percent based on the weight of cyclic oligomers.

Examples of polycarbonates obtained from the cyclic oligomer mixture include poly(4, 4'-hexafluoroisopropylidenebisphenol) carbonate; poly(4,4'-(1,4-phenylenebisisopropylidene)bisphenol) carbonate; poly(4,4'-(1,4-phenylenebisethylidene)bisphenol) carbonate; poly(4,4'-cyclohexylidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethylidenebisphenol) carbonate; poly(4-t-butylcyclohexylidenebisphenol) carbonate; poly(4,4'-hexafluoroisopropylidenebisphenol-co-4,4'-(1,4'-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dimethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; or poly(4,4'-isopropylidene-2,2'-dimethylbisphenol-co-4,4'-cyclohexylidenebisphenol) carbonate.

The following Examples are provided.

EXAMPLE I

Synthesis of BP(A) Cyclic Oligomers

The reaction was conducted in a one liter Morton flask equipped with a mechanical stirrer, a condenser, septum, addition funnel and heating mantle. To this flask were added 200 milliliters of $CH_2Cl_2$, 7 milliliters of deionized water, 3 milliliters of 9.75 Molar NaOH solution, and 2.4 milliliters of triethyl amine. Stirring and gentle reflux were then initiated. Bisphenol A bischloroformate, obtained from VanDeMark Chemical Company of Lockport, NY, previously recrystallized from hexane, about 70.5 grams, were dissolved into 200 milliliters of methylene chloride and added to the above flask by means of a peristaltic pump over a period of 40 minutes. Concurrently, about 59 milliliters of about 9.75 Molar sodium hydroxide solution were added by means of the addition funnel and about 2.4 milliliters of triethyl amine were added by means of a syringe pump. After 40 minutes, the reaction was terminated by the addition of 200 milliliters of 1M HCl solution. The reaction mixture was transferred to a separatory funnel where the organic and aqueous layers separated, and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring sizes of cyclic oligomers of 4,4'-isopropylidene bisphenol carbonate, substantially similar to the oligomers of Brunelle, *Macromolecules*, 1991, 24, 2035; typical distribution of 5 percent dimer, 18 percent trimer, 16 percent pentamer, 9 percent hexamer, and 25 percent larger ring sizes. Confirmation of the product structure was determined by GPC and NMR. GPC analysis showed a cluster of about 6 discernible peaks with the weight average molecular weight for the entire group of about 1,200 Daltons relative to polystyrene. NMR analysis was consistent for a cyclic mixture, about 95 percent, of primarily poly(4,4'-isopropylidene bisphenol) carbonate.

EXAMPLE II 0.25 gram of the BP(A) cyclic oligomers of Example I, 0.25 gram of x metal free phthalocyanine photogenerating pigment, 14.2 grams of cyclohexanone, and about 0.0005 gram of titanium butoxide catalyst were placed in a 30 milliliter bottle containing 70 grams of ⅛ inch stainless steel shot and milled at 300 rpm for 5 days. The dispersion was then coated on aluminum film, heated to about 300° C. for 30 minutes to polymerize the cyclic oligomers and form a polycarbonate resin binder of poly(4,4'-isopropylidene bisphenol) carbonate, about 98 weight percent, and then cooled. Subsequently, an approximately 20 micron thick charge transport layer of 35 weight percent of diphenyl-N,N'-bis(alkylphenyl)-[1,1'-biphenyl]-4,4'-diamine in MAKROLON® was overcoated on the above prepared photogenerator dispersed in the polycarbonate binder resin. Xerographic evaluation of the resulting photoconductive imaging member was accomplished by known means and a sensitivity of about 40 ergs/cm$^2$ was found.

EXAMPLES III TO X

The process of Example II, including dispersion and milling, was repeated for 8 samples with the catalyst and amount as shown in the following Table.

| EXAMPLE | CATALYST | MASS OF CATALYST ADDED TO DISPERSION (MG) |
|---|---|---|
| III | tetrabutylammonium tetraphenylborate | 0.79 |
| IV | tetrabutylammonium tetraphenylborate | 0.27 |
| V | tetraphenylphosphonium tetraphenylborate | 0.77 |
| VI | tetraphenylphosphonium tetraphenylborate | 0.26 |
| VII | aluminum | 0.30 |

-continued

| EXAMPLE | CATALYST | MASS OF CATALYST ADDED TO DISPERSION (MG) |
|---|---|---|
| VIII | di(isopropoxide) acetoacetic ester aluminum | 0.10 |
| IX | di(isopropoxide) acetoacetic ester titanium diisopropoxide bis(2,4-pentanedione) | 0.39 |
| X | titanium diisopropoxide bis(2,4-pentanedione) | 0.14 |

The dispersions were coated onto aluminum and heated to 300° C. for fifteen minutes to effect polymerization of the cyclic oligomer mixture to polycarbonate resin binders comprised primarily of poly(4,4'-isopropylidene bisphenol) carbonate, and then overcoated with a solution of 35 weight percent of diphenyl-N,N'-bis(alkylphenyl)-[1,1'-biphenyl]-4,4'-diamine to 65 weight percent of Polycarbonate Z in toluene for a final dried thickness of approximately 25 microns. The devices or imaging members were evaluated xerographically by charging to a potential of 800 volts.

| EXAMPLE | Blade Gap for CGL* (mil) | Dark Decay (V/s) | $E_{\frac{1}{2}}$ (ergs/cm$^2$) | % dis @ 5 ergs/cm$^2$ | Corotron Voltage (-KV) |
|---|---|---|---|---|---|
| III | 1.0 | 14 | 24.0 | 14 | 5.33 |
| | 1.5 | 27 | 24.0 | 16 | 5.37 |
| IV | 1.0 | 12 | 29.0 | 13 | 5.25 |
| | 1.5 | 25 | 19.6 | 17 | 5.25 |
| V | 1.0 | 9 | 27.0 | 13 | 5.28 |
| | 1.5 | 25 | 30.0 | 13 | 5.28 |
| VI | 1.0 | 10 | 39.0 | 10 | 5.35 |
| | 1.5 | 17 | 33.0 | 12 | 5.35 |
| VII | 1.0 | 11 | 26.0 | 15 | 5.30 |
| | 1.5 | 22 | 29.0 | 14 | 5.30 |
| VIII | 1.0 | 12 | 21.0 | 17 | 5.25 |
| | 1.5 | 31 | 22.0 | 17 | 5.32 |
| IX | 1.0 | 17 | 20.4 | 18 | 5.35 |
| | 1.5 | 33 | 15.1 | 22 | 5.40 |
| X | 1.0 | 21 | 22.0 | 17 | 5.38 |
| | 1.5 | 34 | 30.0 | 13 | 5.45 |

*CGL = photogenerating layer

EXAMPLE XI 0.1 gram of BP(A), the cyclic oligomer mixture of Example I, 0.4 gram of BZP (cis and trans benzimidazole perylene isomers), 12.2 grams of methylene chloride, and about 0.0001 gram of titanium butoxide were placed in a 30 milliliter bottle containing 70 grams of ⅛ inch stainless steel shot followed by milling at 300 rpm for 7 days. The dispersions were then coated on an aluminum film, heated to about 300° C. for 15 minutes to polymerize the cyclic oligomers and then cooled. Subsequently, an approximately 20 micron thick charge transport layer of 35 weight percent of diphenyl-N,N'-bis(alkylphenyl)-[1,1'-biphenyl]-4,4'-diamine dispersed in MAKROLON® was overcoated on the above formed CGL. Xerographic evaluation of the resulting member was accomplished and a photosensitivity of about 12 ergs/cm$^2$ was found.

Other modifications of the present invention may occur to those skilled in the art subsequent to a review of the present application and these modifications, including equivalents thereof, are intended to be included within the scope of the present invention.

What is claimed is:

1. A process for the preparation of photoconductive imaging members consisting essentially of coating a supporting substrate with a photogenerator layer comprised of photogenerating pigments contained in a mixture of cyclic oligomers with degrees of polymerization of from about 2 to about 20 and a catalyst, and wherein said mixture is heated to obtain a polycarbonate resin binder from said cyclic oligomers, and subsequently applying to the photogenerating layer a layer comprised of charge transport molecules; and wherein said cyclic oligomeric mixture is comprised of components represented by the formula

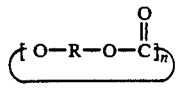

where n represents the degree of polymerization and is from about 2 to about 20, and R represents the principle repetition unit of the formula

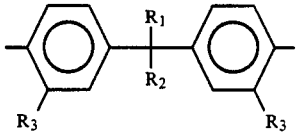

wherein $R_1$, $R_2$, and $R_3$ are independently selected from the group consisting of hydrogen, alkyl, aryl, halogen, halogen substituted alkyl and halogen substituted aryl.

2. A process in accordance with claim 1 wherein the cyclic oligomer mixture contains linear oligomers as a minor component in an amount of from about 15 percent to about 20 percent by weight.

3. A process in accordance with claim 1 wherein two or more cyclic oligomer mixtures with dissimilar repetitive units are selected to obtain a copolycarbonate.

4. A process in accordance with claim 1 wherein a crosslinking agent is added to the cyclic oligomer mixture.

5. A process in accordance with claim 1 wherein the polycarbonate resin binder product is poly(4,4'-hexafluoroisopropylidenebisphenol) carbonate; poly(4,4'-(1,4-phenylenebisisopropylidene)bisphenol) carbonate; poly(4,4'-(1,4-phenylenebisethylidene)bisphenol) carbonate; poly(4,4'-cyclohexylidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethylidenebisphenol) carbonate; poly(4-t-butylcyclohexylidenebisphenol) carbonate; poly(4,4'-hexafluoroisopropylidenebisphenol-co-4,4'-(1,4-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dimethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; or poly(4,4'-isopropylidene-2,2'-dimethylbisphenol-co-4,4'-cyclohexylidenebisphenol) carbonate.

6. A process in accordance with claim 1 wherein said mixture is heated at a temperature of from between about 200° C. to about 300° C.

7. A process in accordance with claim 1 wherein heating is accomplished by radiative heat, inductive radio frequencies, or by microwave radiation.

8. A process in accordance with claim 1 wherein the coating of photogenerator and mixture cyclic oligomers and charge transport molecules is accomplished by solution coating methods, melt coating methods, or powder coating methods.

9. A process in accordance with claim 1 wherein the catalyst is selected from the group consisting of aluminum di(isopropoxide)acetoacetic ester chelate, tetrabutylammonium tetraphenylborate, tetramethylammonium tetraphenylborate, titanium diisopropoxide bis(2,4-pentanedione), titanium tetraisopropoxide, titanium tetrabutoxide, tetraphenylphosphonium tetraphenylborate, lithium phenoxide, and lithium salicylate.

10. A process in accordance with claim 1 wherein the obtained polycarbonate has a weight average molecular weight of between 50,000 and 300,000.

11. A process in accordance with claim 1 wherein the charge transport molecules are comprised of aryl diamines.

12. A process in accordance with claim 1 wherein the charge transport molecules are comprised of aryl amines of the formula

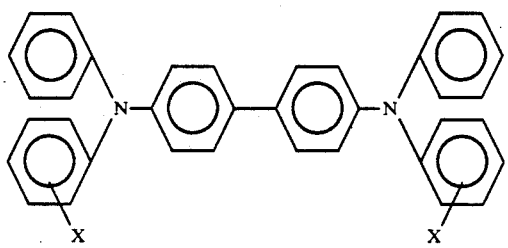

wherein X is selected from the group consisting of alkyl and halogen.

13. A process in accordance with claim 1 wherein the mixture contains from about 15 to about 75 percent by weight of said oligomers.

14. A process in accordance with claim 1 wherein the mixture contains from about 25 to about 85 percent by weight of the photogenerating pigments.

15. A process in accordance with claim 1 wherein the cyclic oligomers are comprised of 4,4'-isopropylidene bisphenol carbonate, the photogenerating pigment is X-metal free phthalocyanine, the charge transport layer is comprised of molecules of N,N'-bis(alkylphenyl)-[1,1'-biphenyl]-4,4'-diamine, and the catalyst is tetrabutylammonium tetraphenylborate, teraphenylphosphonium tetraphenylborate, titanium diisopropoxide, or aluminum di(isopropoxide) acetoacetic ester.

16. A process in accordance with claim 15 wherein heating is accomplished at 300° C. to effect polymerization of the cyclic oligomer mixture to a polycarbonate.

17. A process in accordance with claim 16 wherein the polycarbonate is poly(4,4'-isopropylidene bisphenol) carbonate.

18. The process in accordance with claim 1 wherein the polycarbonate resin binder possesses a molecular weight of from about 100,000 to about 300,000.

19. A process for the preparation of photoconductive imaging members comprised of a supporting substrate, a photogenerating layer, and a layer comprised of charge transport molecules, and wherein the photogenerating layer contains photogenerating pigments dispersed in a polycarbonate resinous binder, the improvement residing in heating said photogenerating pigments contained in a mixture of cyclic oligomers with a degree of polymerization of from about 2 to about 20 and a catalyst; and wherein there results said polycarbonate resinous binder selected from the group consisting of poly(4,4'-hexafluoroisopropylidenebisphenol) carbonate; poly(4,4'-phenylenebisisopropylidene)bisphenol) carbonate; poly(4,4'-phenylenebisethylidene)bisphenol) carbonate; poly(4,4'-cyclohexlidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethyldenebisphenol) carbonate; poly(4-t-butylcyclohexylidenebisphenol) carbonate; poly(4,4'-hexafluoroisopropylidenebisphenol-co-4,4'-(1,4-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dimethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; or poly(4,4'-isopropylidene-2,2'-dimethylbisphenol-co-4,4'-cyclohexylidenebisphenol) carbonate.

20. A process in accordance with claim 19 wherein the polymerization is accomplished at a temperature of from about 200 ° to about 300° C.

21. A process in accordance with claim 19 wherein the mixture contains from about 5 to about 75 percent by weight of the oligmers; and the photogenerating pigment is a metal free phthalocyanine, a metal phthalocyanine, titanyl phthalocyanine, selenium, or benzimidazole perylenes.

* * * * *